United States Patent [19]

Simko

[11] 4,386,587

[45] Jun. 7, 1983

[54] TWO STROKE CYCLE ENGINE WITH INCREASED EFFICIENCY

[75] Inventor: Aladar O. Simko, Dearborn Heights, Mich.

[73] Assignee: Ford Motor Company, Dearborn, Mich.

[21] Appl. No.: 333,244

[22] Filed: Dec. 21, 1981

[51] Int. Cl.[3] ..... F02B 75/06; F02B 77/08

[52] U.S. Cl. ..... 123/65 R; 123/65 A; 123/65 VD; 123/182

[58] Field of Search ..... 123/182, 65 A, 65 VD, 123/65 R

[56] References Cited

U.S. PATENT DOCUMENTS

| | | | |
|---|---|---|---|
| 684,011 | 10/1901 | Valentynowicz | 123/182 |
| 780,556 | 1/1905 | Doman | 123/182 |
| 1,623,589 | 4/1927 | Granata | 123/182 |
| 2,699,159 | 1/1955 | Murray | 123/182 |
| 2,742,380 | 4/1956 | Peters | 123/182 |
| 3,057,336 | 10/1962 | Hatz, Jr. | 123/182 |
| 3,113,561 | 12/1963 | Heintz | 123/65 R |
| 3,335,563 | 8/1967 | Kitchen | 60/597 |
| 3,821,941 | 7/1974 | Rychlik | 123/65 VA |
| 3,875,909 | 4/1975 | May | 123/65 WA |
| 4,128,085 | 12/1978 | Kuni | 123/90.46 |
| 4,312,308 | 1/1982 | Slattery | 123/182 |

*Primary Examiner*—Wendell E. Burns

*Attorney, Agent, or Firm*—Joseph W. Malleck; Olin B. Johnson

[57] ABSTRACT

A method and apparatus is disclosed for decreasing fuel consumption in a variably loaded, two cycle internal combustion engine. Fluid communication is provided between the working cylinder and air chamber during the upward stroke of the engine up to about 85°-105° BTDC, during which time the cylinder gases can flow back into the air chamber reducing engine friction as a result of a delay in the rise of the cylinder gas pressure during compression and a reduction in the peak compression pressure.

15 Claims, 4 Drawing Figures

TWO STROKE CYCLE ENGINE WITH INCREASED EFFICIENCY

BACKGROUND OF THE INVENTION

Two stroke cycle engines have been used heretofore mostly in extreme sized applications, being either very small or very large engine applications. The small engine applications are represented by such applications as lawn mowers and motor bikes where the low cost of manufacture is of paramount importance and some inefficiency of operation can be tolerated. In these applications, the bottom of the piston is used as a scavenging blower. The very large marine engine applications have been for use in ore boats, ships, etc., where the large reciprocating mass of the piston and connecting rod that is moved about would cause the four stroke cycle engine operation to be inefficient compared to the two stroke. Also, when these large applications have a need for scavenging and supercharging, large, expensive blowers are required as well as other accessory equipment. Such expense is tolerated because of the large capital investment of the application.

In midsize engine applications, the two stroke cycle engine has not been used widely, except for two stroke diesel truck engines having a four valve exhaust system. In this arrangement the cam operated exhaust ports are operated with an asymmetrical timing relative to BTDC (Before Top Dead Center), but the intake ports are opened and closed symmetrically since they are controlled by the piston operation. During the downstroke the exhaust valves open before the intake ports to assure a blowdown of the relatively high cylinder pressure prior to the scavenging process. On the upstroke the exhaust valves are closed earlier than the intake ports to provide for an increased pressure and charge density in the cylinder prior to the compression event. This timing schedule provides for fairly high specific output. It is not conducive to high fuel efficiency because with a compression ratio, for example, of about 16:1, the expansion ratio would be only 14:1. The fuel efficiency of such engine is related to its expansion ratio.

Another problem that has deterred further development of the two stroke engine for midsize applications occurs at part load where less fuel and less air is required of the engine. If the engine designer were to reduce fuel delivery at part load, the same amount of air would still be pumped in by the constant speed compressor. This lack of proportioning results in misfirings of the engine.

SUMMARY OF THE INVENTION

The invention is a method and apparatus for decreasing fuel consumption in a variably loaded, two cycle internal combustion engine. The two cycle engine is of the type having an air chamber surrounding the working cylinder, the air chamber normally receiving pressurized air for supply to the working cylinder when the piston of the engine is in a preselected expanded position.

The method is characterized by decreasing the compression ratio of the engine by permitting communication between the working cylinder and the air chamber during the upward stroke of the engine up to about 85°-105° BTDC, during which the cylinder gases can flow back into the air chamber reducing engine friction as a result of a delay in the rise of the cylinder gas pressure during compression and a reduction in the peak compression pressure. This method particularly increases the efficiency of the two stroke cycle engine during part load conditions providing a compression ratio which is consistently greater than the expansion ratio and by eliminating the excess air problem.

In carrying out the method, it is preferable that the compression ratio be selectively reduced only during part or light load conditions corresponding to a part throttle position. This is desirably carried out by employing a butterfly valve in the channel providing supplementary communication between the air chamber and the working cylinder, the butterfly valve being normally closed during high load conditions to maintain the compression ratio at normal values and selectively opened during part load conditions to permit such communication. It is also desirable that the supplementary communication be provided by an auxiliary intake valve positioned in a channel in the head of the engine adjacent the exhaust valve, the channel communicating with the air chamber disposed about the sides of the cylinder sleeves.

To facilitate even greater decrease in fuel consumption for the above method, it is preferred that (a) the auxiliary intake valve as well as exhaust valves be driven by a mechanical desmodromic cam shaft system whereby the cam shaft is loaded with forces only required to operate the valves at momentary speeds, thereby reducing parasitic valve drive losses, (b) the air supply for the air chamber be generated by a blower driven by the engine output shaft through a differential mechanism effective to provide a blower speed and air flow output proportional to engine torque output during the lower speed range of engine operation and proportional to engine speed during high speed, high load conditions, and (c) the coolant pump be driven by the air blower drive shaft causing the coolant flow to the proportional to the mass air flow delivered to the engine and thereby eliminating excessive coolant pump power absorption under light load conditions.

It is advantageous that the opening and closing of the intake and exhaust valves as well as the opening and closing of the auxiliary intake valve be arranged to provide a compression ratio of about 10:1 and an expansion ratio of about 13:1.

With respect to the apparatus, a primary feature consists of mechanical means that provide, during part load engine conditions, a fluid communication between the trailing end of the working cylinder and the air supply for a preselected period after the intake and exhaust valve have been closed. Such means effects a delay in the rise of the cylinder pressure during the initial period of the upward stroke and promotes a reduction in the peak compression pressure to reduce engine friction.

The compression ratio reducing means preferably takes the form of a channel communicating the working chamber through the head of the engine with air supply chambers surrounding the side walls of the working cylinder sleeves. The channel is cyclicly opened and closed by an auxiliary intake valve positioned adjacent the other valves in the head of the working cylinder. The auxiliary intake valve is preferably actuated by a desmodromic drive. The channel is normally closed by a butterfly valve during full load conditions and opened by such valve during part load conditions.

Fuel consumption can be further decreased by combining the above apparatus feature with the additional feature of a variable drive mechanism for the air supply or blower. The variable drive assures that the mass airflow of the blower will be proportional to engine torque during the lower speed range of engine operation and, when high speed, high load conditions are desired, the mechanism provides for mass airflow proportional to speed of the engine. The differential drive mechanism may preferably take the form of a planetary gear set interposed between the engine output shaft and the transmission input shaft; the engine output shaft driving the planet carrier, the ring gear driving the transmission, and the sun gear, through an additional gear set, driving the blower. Under high speed, high load conditions, a lockup clutch is used to remove relative movement between the ring gear and planetary drive gear, thereby providing a direct drive to the transmission to force the blower speed to be proportional with engine speed.

DETAILED DESCRIPTION

Figure 1:
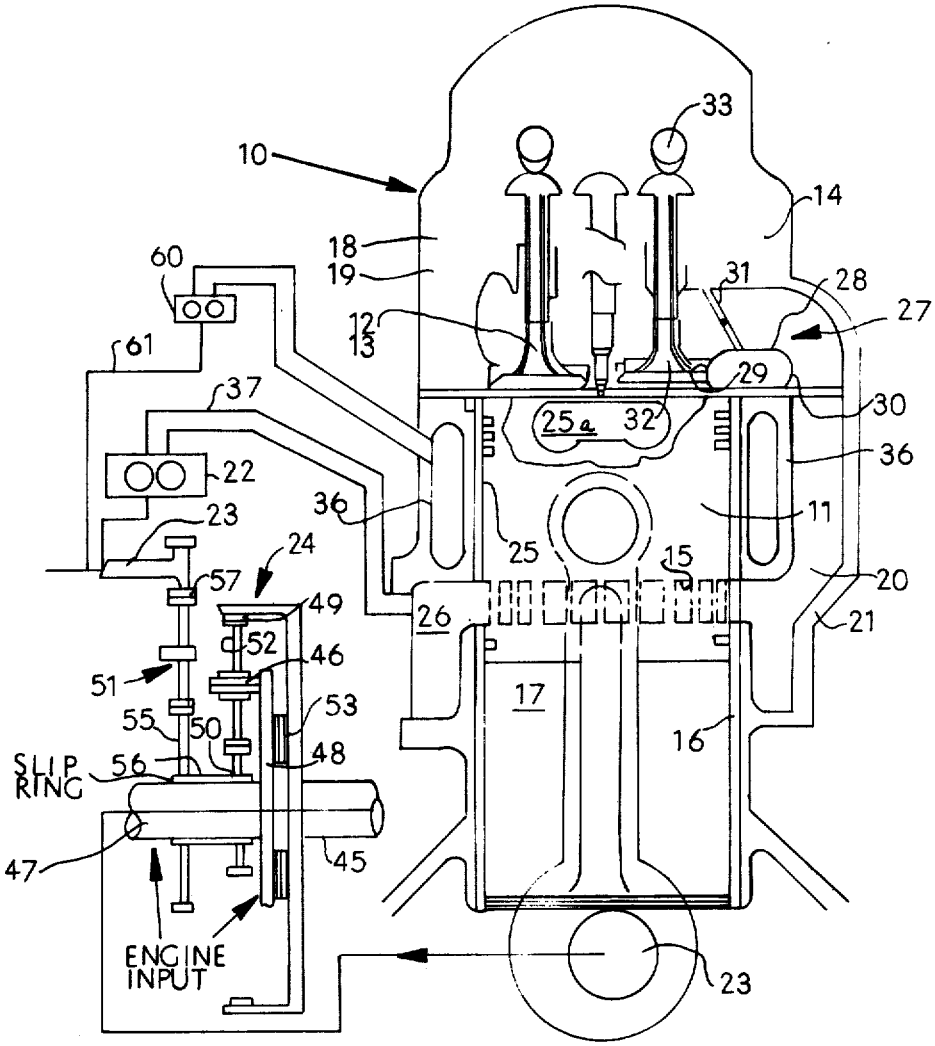
FIG. 1 is an elevational view of a two stroke automotive engine employing the features of this invention, portions thereof being shown in cross-section and other portions being shown in schematic form.
Figure 3:
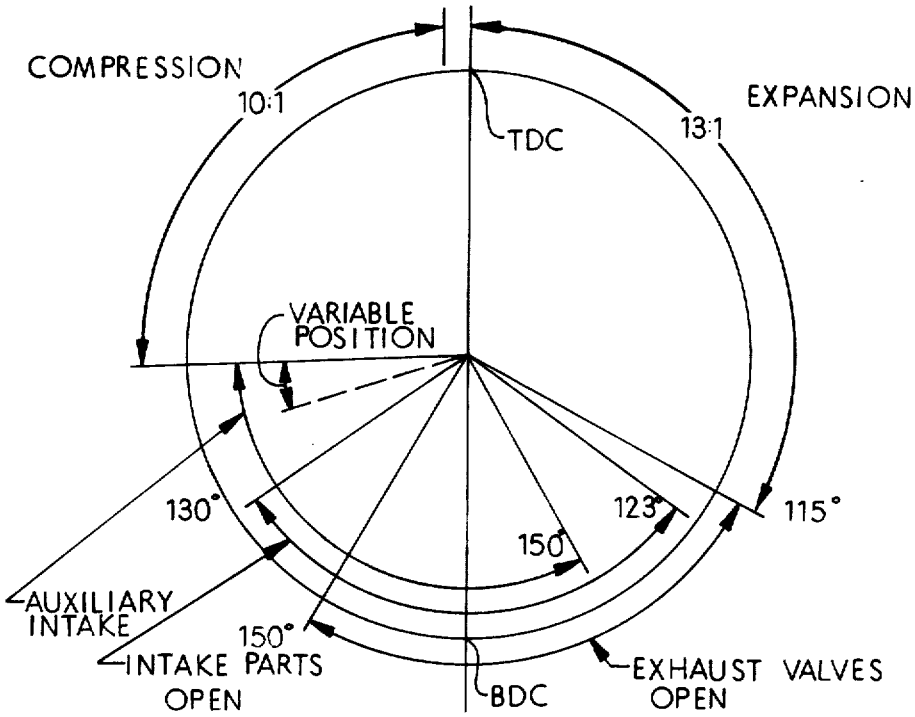
FIG. 3 is a timing diagram illustrating the opening and closing of the various valves with respect to one reciprocal movement of the piston.
Figure 4:
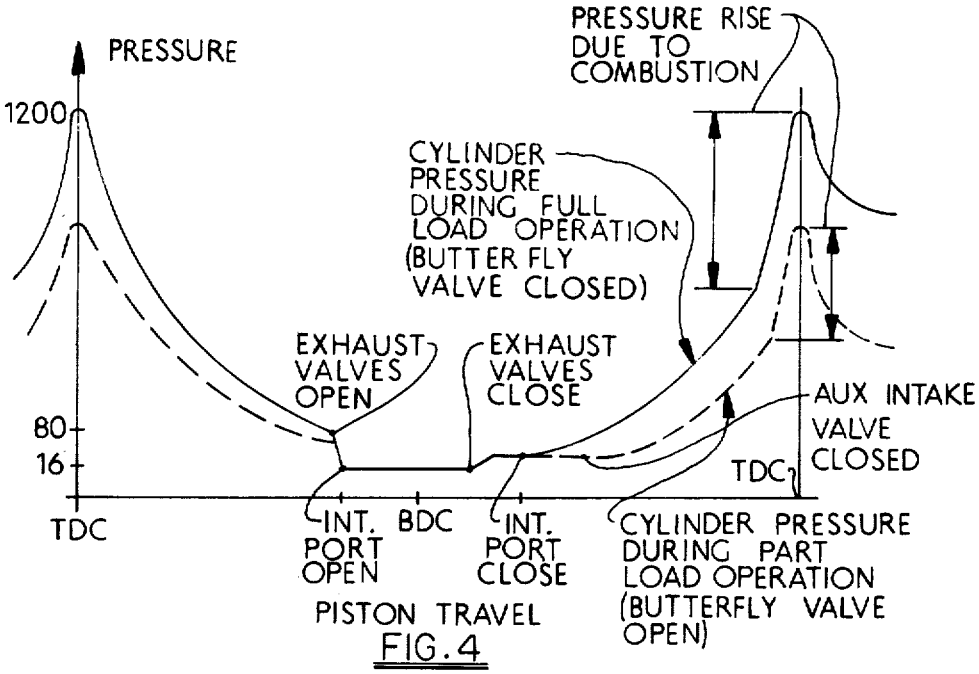
FIG. 4 is a graphical illustration of working cylinder pressure as a function of piston travel for a single cycle of the apparatus of FIG. 1.

In a two stroke cycle engine 10, as shown in FIG. 1, the piston 11 is used for power production in every downstroke rather than in every other downstroke as in a four stroke cycle engine. This improves mechanical efficiency and facilitates the use of a lesser number of cylinders. Typically, two exhaust valves 12 and 13 are accommodated in the cylinder head 14. The intake ports 15 are arranged as a plurality of openings in the side wall 16 of the cylinder sleeve and are arranged circumferentially around such sleeve so that the ports will be uncovered or opened by the piston when near bottom dead center position (it is shown in the top dead center position). Thus, in typical operation of a two stroke cycle engine, the piston will reciprocate within the working cylinder 17 between a top and bottom position, every downstroke being a power stroke and every upstroke being a recovery stroke. During compression and expansion, the exhaust and intake ports are closed. When piston 11 reaches a position of about 115° ATDC (After Top Dead Center), see FIG. 3, the exhaust valves 12 and 13 will open ports 18 and 19. At about 123° ADTC (see FIG. 3), the intake ports 15 will be uncovered. These conditions will prevail until the exhaust valves close at about 150° BTDC (Before Top Dead Center). The intake ports are covered again by the piston at about 130° BTDC. The intake ports, being tied to the operation of the piston, will have their opening and closing symmetrical with respect to the operation of the piston.

Air is pumped into the intake ports from an air chamber 20 having walls 21 which form a jacket about the side walls of the cylinder sleeves 16 and the cooling jacket 36. The exhaust gases are expelled from the working cylinder 17 and fresh, pressurized air is introduced as supplied by the chamber 20 which receives pressurized air via duct 37 from a blower 22. The blower 22 is driven from the output shaft 23 of the engine through a differential drive mechanism 24.

To increase fuel efficiency, the expansion ratio is increased relative to the compression ratio. The compression process is only necessary to facilitate high expansion ratio before the cylinder pressure expands to below atmospheric pressure. This requirement can be satisfied in general with a compression ratio that is only 0.7–0.8 times as high as the expansion ratio. Such an arrangement, if embodied in a hardware with high mechanical efficiency, will provide for the highest fuel efficiency within other practical limitations. The reason it is desirable to minimize the compression ratio is that the work required during the compression stroke is only partially recovered during the expansion stroke, therefore the lower the compression stroke work, the lower the associated work loss.

A decrease in the compression ratio of the engine will facilitate a reduction in engine friction due to a delay in the rise of cylinder pressure and a reduction in the peak compression pressure. To accomplish this, means 27 for communicating the trailing end **25*a* of the working cylinder 25 with the air supply 26 is provided during part load engine conditions. Communication is maintained for a preselected period after the intake and exhaust ports have been closed. Maintenance of a gaseous communication between the air chamber 26 and the trailing end of the working cylinder 25 reduces the compression ratio. Preferably, the fluid communication is provided by way of a channel 28 which extends from an opening 29 in the roof of the working cylinder 25 through the head of the engine to a port 30 communicating with the top of the air supply chamber 20. To ensure that fluid communication is effective only during part load conditions, a butterfly valve 31 is preferably employed to permit communication during such part load conditions but to close off the fluid communication during high speed, high load conditions or maximum power conditions. The communication is also controlled with respect to each cycle of the piston; it is opened and closed by way of an auxiliary intake valve 32 actuated by a desmodromic drive 33 carried by the head 14** of the engine.

During a typical reciprocal cycle of the piston, the auxiliary intake valve 32 is actuated by the desmodromic drive to open at about 150° ATDC and remain open long after the intake ports and exhaust valves have been closed. The auxiliary valve 32 will then close at about 95° BTDC. The compression ratio is the difference between the volume of the working cylinder at the time when the auxiliary intake valve closes to its volume at the time the piston reaches top dead center; this is preferably designed to be about 10:1. The expansion ratio will be approximately 13:1 and is significantly greater than the compression ratio. The auxiliary intake port allows gases from the working cylinder to flow back into the air chamber and thereby reduce the effective compression ratio. The reduced compression ratio results in a favorable reduction in engine friction because the cylinder pressure will start rising only after a later point in the compression stroke and the peak compression pressure will be less than that corresponding to the 13:1 expansion ratio of prior art devices. This method of compression ratio reduction effectively reduces the amount of air trapped in the working cylinder. Whereas this is desirable for part load operation, it is not desirable when maximum power is required because the reduced quantity of trapped air proportionately reduces the attainable maximum power. This deficiency is eliminated by the closing of the butterfly valve whenever high or maximum output is required from the engine.

In conventional engines the intake and exhaust valves are driven in their opening strokes by a cam and returned to a closed position by strong springs designed to attain designed closing velocities even beyond the maximum rate of speed of the engine. This arrangement necessitates a drive torque requirements for the cam shaft significantly higher than required purely for the opening and closing of the valves. Even at low speeds, when the acceleration requirements are low, the cam shaft must compress the highly loaded springs through a mechanism of low mechanical efficiency. Only a fraction of the spring compression work is recovered during the valve closing event.

Figure 2:
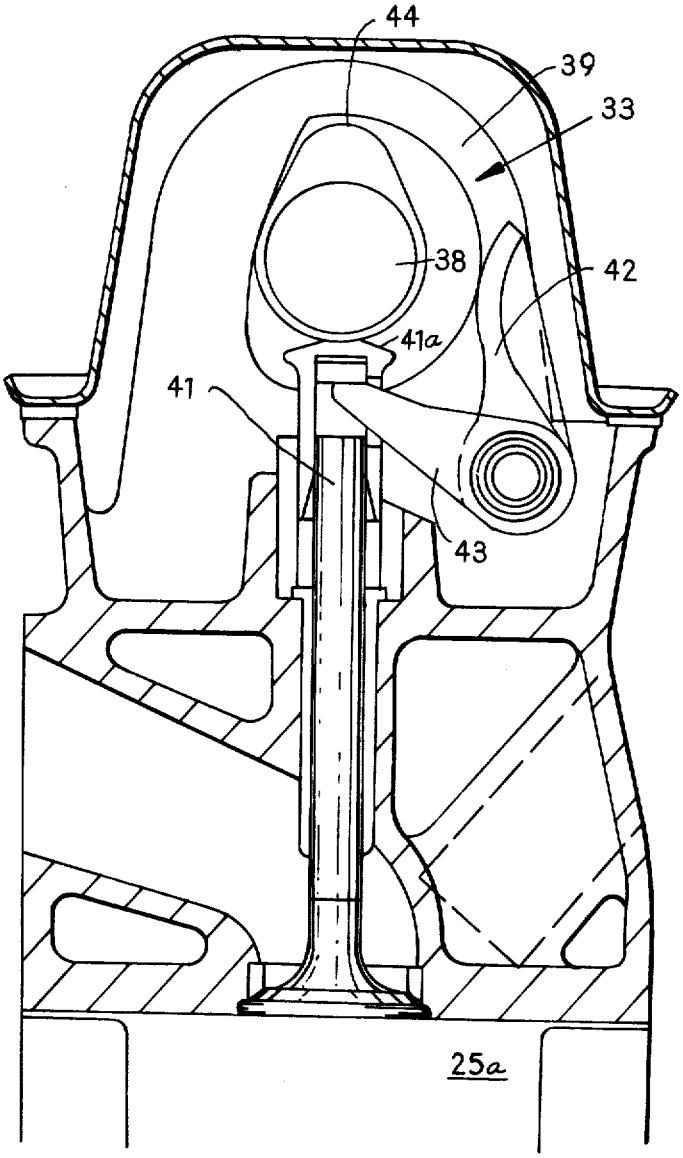
FIG. 2 is a sectional view of the upper portion of FIG. 1 taken substantially along another section line.

In this invention, additional engine friction reduction is provided by the combined use of the desmodromic drive 33 to actuate the head valves including the auxiliary intake valve 32. By use of the desmodromic drive 33, the cam shaft 38 is loaded only with the forces required to operate the valves at the momentary speed. Thus, at low speeds significant parasitic losses are saved. The desmodromic drive (as shown in FIG. 2) consists of a first cam 39 on the cam shaft 38 which when rotated actuates a lever 42 having another arm 43 which in turn raises the valve stem 41 to a closing position. The first cam 39 is arranged in combination with another cam surface 44 which when rotated acts directly on the top 41*a* of the valve stem to create an opening force. This arrangement facilitates much faster acceleration rates and the cam shaft drive torque requirement is significantly reduced at lower speeds.

It has been discovered that a further synergistic reduction in engine friction can be achieved in combination with the above features by use of a differential drive mechanism 24 for the air blower so that during part load conditions the blower will be operated proportional to the engine torque. But when maximum torque conditions are experienced, the differential drive mechanism will be shifted to a condition whereby the blower output will be proportional to the speed of the engine.

It is preferable that such differential means 24 to drive the blower take the form of a planetary gear set interposed between the engine output shaft 23 and the transmission input shaft 45. The engine output shaft drives the planet carrier 46 by way of input shaft 47 and plate 48. The ring gear 49, driven by the planet gear 52, drives the transmission input shaft 45. The sun gear 50, driving through an additional gear set 55, 51, 57, to drive the blower 22. This gear set will deliver at all times a certain predetermined fraction of the engine torque to the sun gear 50. The rest of the torque fraction is delivered to the transmission. This relationship is advantageous at low load conditions when the airflow requirements are low. The engine torque is low, therefore, the blower speed automatically drops off. When the output torque requirement increases, a higher fueling rate will increase the engine torque, thus higher torque will be delivered to the sun gear, causing the blower to speed up. For very high torque output, supercharging pressures will be generated with fast response time. This supercharging capability does not penalize part load fuel economy by high blower speeds at light loads.

Under maximum torque conditions, as the engine speed increases, the blower airflow with this drive system will tend to remain constant in terms of pounds per hour, resulting in a drop in air/lbs. per cycle. To eliminate this undesirable aspect, a lockup clutch 53 is employed which is actuated as about 50–60% of maximum engine speed, converting the drive of the blower to one which is proportional to engine speed. The ring gear 49 and planetary gear 52 will be locked up, forcing a one-to-one ratio drive to the sun gear 50 as this gear is coupled to gear 55 through sleeve 56 and the other gear set 51, 57. The blower drive gear 57 will be driven proportional to engine speed. In passenger car operation this mode would be used infrequently, typically only for heavy, high speed accelerations. Since the differential blower drive results in a slight drop of engine speed when the output torque requirement is reduced at constant vehicle speed, this automatically varies the N/V ratio which is beneficial for both fuel economy and driveability.

In prior art engines the engine coolant pump is driven off the crankshaft with a fixed drive ratio. This arrangement provides for higher than necessary coolant flow rates at part loads thereby wasting energy. The fuel flow rate and the cooling requirements are roughly proportional to the mass airflow rate therefore it is desirable to drive the coolant pump in proportion to the mass airflow rate. This is accomplished in this invention by attaching the cooling pump drive to the blower driveshaft 23, thereby making the coolant flow rate proportional to the mass airflow that is being delivered to the engine. This arrangement eliminates excessive coolant pump power absorption under light load conditions.

The essence and the intent of this invention can also be accomplished by applying alternative means to closing channel 27, 28 during high load operation. One of these means could be a deactivating mechanism for the activation of the auxiliary valve 33 such that under high load conditions the auxiliary valve remains spated throughout the entire engine cycle. Another alternative means can be a variable valve timing or variable valve event mechanism which would advance the closing time of valve 33 for high load operation to occur no later than when the intake ports are being closed (130° BTDC in this example). Mechanisms for the purpose of valve deactivation and for the purpose of valve timing or valve event changes are known to those familiar with engine design and control technology.

I claim:

1. A method of decreasing fuel consumption in a two cycle internal combustion engine having an air chamber surrounding working cylinder, the air chamber normally receiving pressurized air for supply to the working cylinder when the piston is in a preselected expanded position, the method comprising:

decreasing the compression ratio of the engine by permitting fluid communication between said working cylinder and air chamber during the upward stroke when the engine is under part load conditions, said communication being maintained up to about 85°–105° BTDC during which time the cylinder gases can flow back into the air chamber reducing engine friction by a delay in the rise of cylinder pressure during compression and a reduction in peak compression pressure.

2. The method as in claim 1, wherein said fluid communication is permitted only during part or light load conditions of the engine and said fluid communication is closed off during substantially full load engine conditions.

3. The method as in claim 2, wherein said fluid communication is closed by way of a butterfly valve carried in a channel communicating the working cylinder with said air supply chamber, said butterfly valve being in closed position during substantially full load conditions and in an open condition during part load engine conditions.

4. The method as in claim 1, wherein said fluid communication is provided by way of a channel defined in the head of said engine communicating the roof of said working cylinder with said air chamber.

5. The method as in claim 4, wherein the intake ports for said working cylinder are arranged as a plurality of openings through the side wall of said cylinder and stationed at a position slightly above bottom dead center for the piston.

6. The method as in claim 1, wherein a valve carried by said engine is effective to open and close said fluid communication in accordance with the reciprocal movement of said piston, said valve being driven by a drive mechanism directly coupled to the engine output shaft.

7. The method as in claim 6, wherein said drive mechanism comprises a desmodromic system effective to operate said valve as well as the exhaust valves of said engine.

8. The method as in claim 1, wherein said pressurized air supply is provided by a blower driven by the output of said engine through a differential drive mechanism that ensures that the mass airflow of said blower output will be proportional to engine torque during the lower speed range of engine operation and proportional to engine speed during high speed, high load conditions.

9. The method as in claim 8, wherein said differential drive mechanism comprises a planetary gear mechanism, the input to said planetary gear mechanism being to the planetary gear, the output for the blower being taken through the sun gear of said planetary gear set, a lockup clutch being employed to lock the planetary gear to the ring gear during high speed, high load conditions to provide a mass airflow proportional to engine speed.

10. The method as in claim 9, wherein said engine further comprises a coolant pump driven by the blower driveshaft whereby the coolant flow to the engine will be proportional to the mass airflow delivered to the engine.

11. In a two stroke cycle engine having a working cylinder and a reciprocating piston, and a multiplicity of intake ports in the side walls of said cylinder and one or more exhaust ports in the head of said cylinder, and means for opening and closing said ports in accordance with the operation of said piston, the apparatus comprising:

(a) walls defining an air chamber about said cylinder for supply of pressurized air to said intake ports;

(b) means providing, during part load engine conditions, a fluid communication between the trailing end of said working chamber and said air chamber for a preselected period after the intake and exhaust ports have been closed to thereby lower the compression ratio without affecting the expansion ratio; and (c) blower means operatively connected to said piston for delivering pressurized air to said air chamber.

12. The apparatus as in claim 11, wherein said fluid communicating means includes a channel extending between an auxilliary intake port to said cylinder and said air chamber, a butterfly valve effective to close said channel when the engine is under full load conditions and to open said channel during part load conditions, and an auxilliary intake valve effective to close said auxilliary intake port during a preselected period of each cycle of said piston operation.

13. The apparatus as in claim 12, wherein the auxilliary intake valve is actuated by a desmodromic drive driven by said engine.

14. The apparatus as in claim 11, wherein said operative connection for said blower means comprises a differential mechanism for driving the blower in proportion to engine output torque when the engine is in part load conditions and for driving the blower proportional to engine speed when the engine is under full load conditions in the higher speed range.

15. The apparatus as in claim 14, wherein said differential mechanism comprises a planetary gear set having drive input to the planetary gear and one output from said set to a ring gear connected to the transmission, another output to the sun gear connected to said blower, and said planetary gear carrier being locked up to said ring gear when said engine is under full load conditions to make the output to said blower proportional to engine speed.

* * * * *